United States Patent [19]

Kelley et al.

[11] Patent Number: 4,500,299

[45] Date of Patent: Feb. 19, 1985

[54] TOY CARGO PLANE

[75] Inventors: William J. Kelley, Torrance; Terry K. Prince, Palos Verdes, both of Calif.

[73] Assignee: Mattel, Inc., Hawthorne, Calif.

[21] Appl. No.: 496,149

[22] Filed: May 19, 1983

[51] Int. Cl.[3] ..... A63H 27/00

[52] U.S. Cl. ..... 446/230; 446/88; 446/6

[58] Field of Search ..... 446/88, 230, 231, 6, 446/34, 35, 424, 425, 426, 427, 428; 16/233, DIG. 5, DIG. 30, DIG. 41; 244/118.2, 118.3, 129.5, 137 R

[56] References Cited

U.S. PATENT DOCUMENTS

| | | | |
|---|---|---|---|
| 1,873,243 | 8/1932 | Zebronski | 49/112 |
| 2,425,499 | 8/1947 | Watter | 244/118 R |
| 2,434,464 | 1/1948 | Lemonier et al. | 244/137 R |
| 2,551,340 | 5/1951 | Sands, Jr. | 446/88 |
| 2,750,929 | 6/1956 | Bronson | 49/111 |
| 2,781,226 | 2/1957 | Tydon | 244/118.2 |
| 2,876,969 | 3/1959 | Tydon et al. | 244/118.3 |
| 3,741,504 | 6/1973 | Abberti | 248/119 R |
| 4,039,163 | 8/1977 | Shorey | 244/137 R |
| 4,165,810 | 8/1979 | Young | 414/595 |
| 4,249,339 | 2/1981 | Crain et al. | 46/232 |

*Primary Examiner*—Robert A. Hafer
*Assistant Examiner*—Daniel Nolan
*Attorney, Agent, or Firm*—Ronald Goldman; James O'Neill

[57] ABSTRACT

A toy cargo plane having a fuselage (24) with two front doors (32, 34) pivotably mounted within the front of the fuselage. The doors are mechanically opened by actuation of a lever and rod arrangement (44, 46) slideable along its axis and mounted within a slot formed in the tail end of the body. A further lever and rod arrangement (50, 52) slideably moves a ramp (36) in and out of the open front doors to enable vehicles or other toys to be loaded onto the ramp.

8 Claims, 11 Drawing Figures

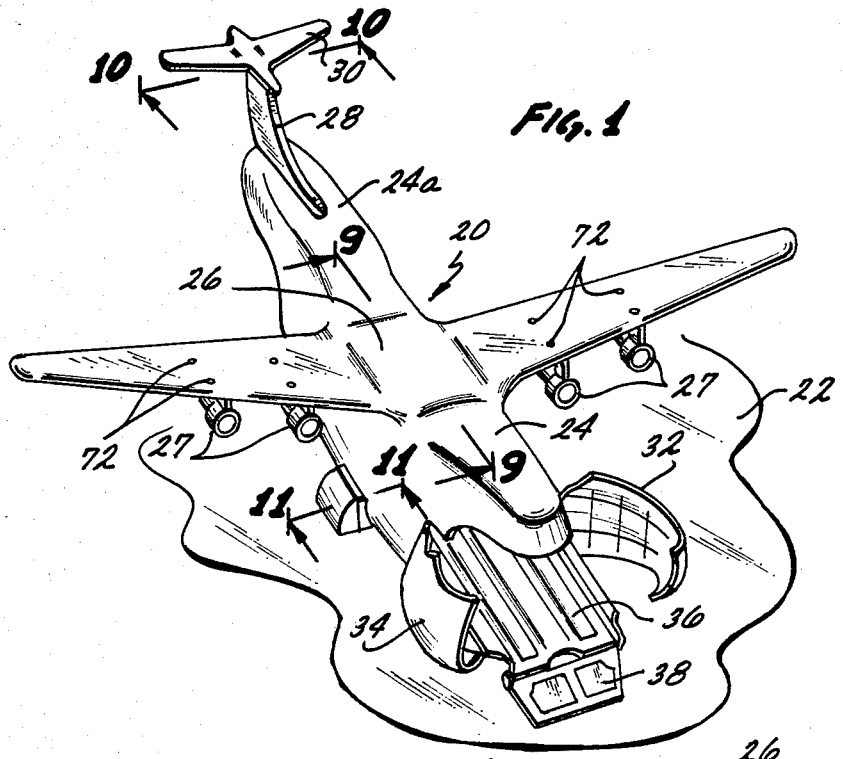
FIG. 1
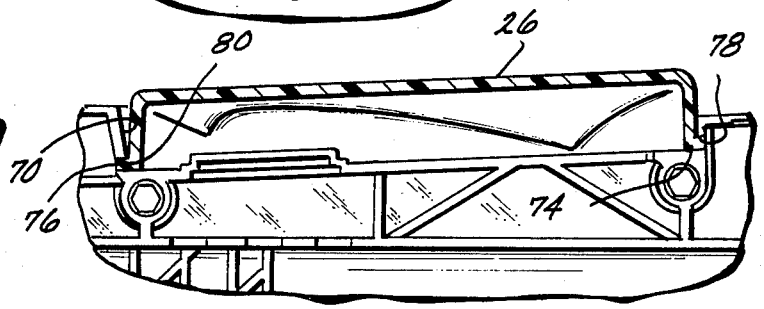
FIG. 9
FIG. 11
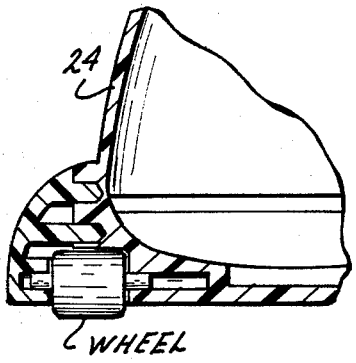
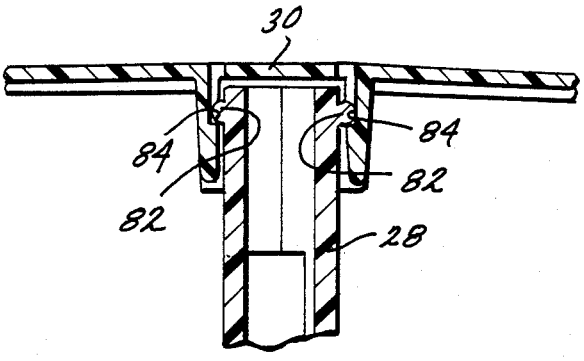
FIG. 10

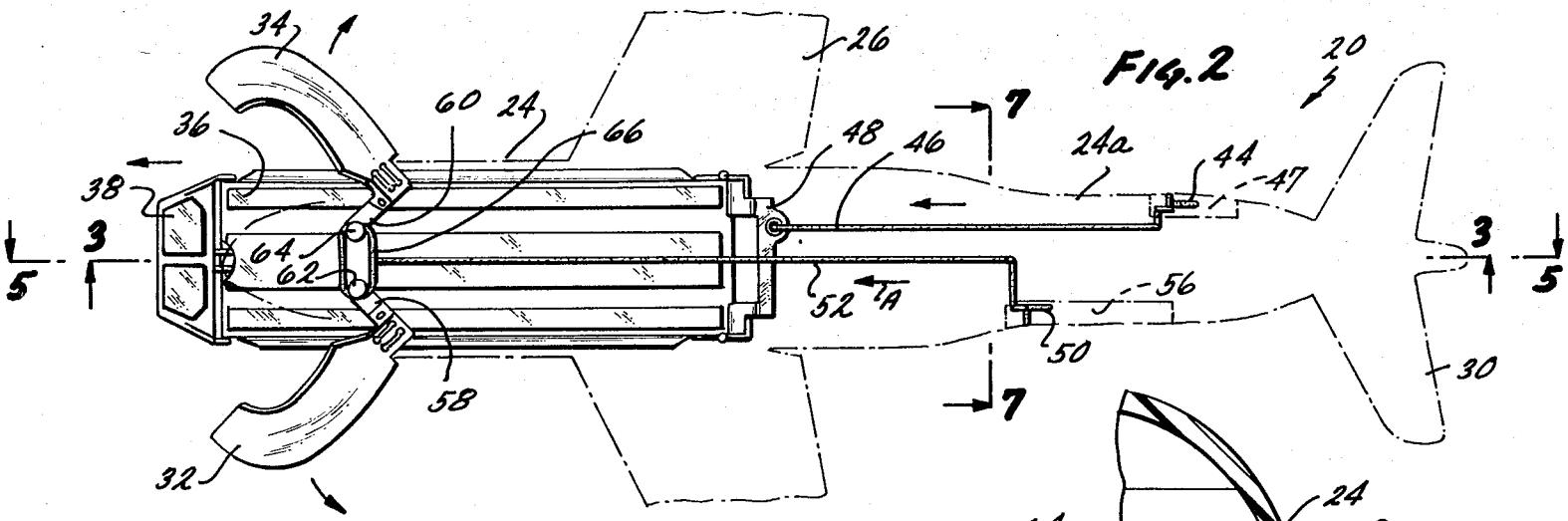
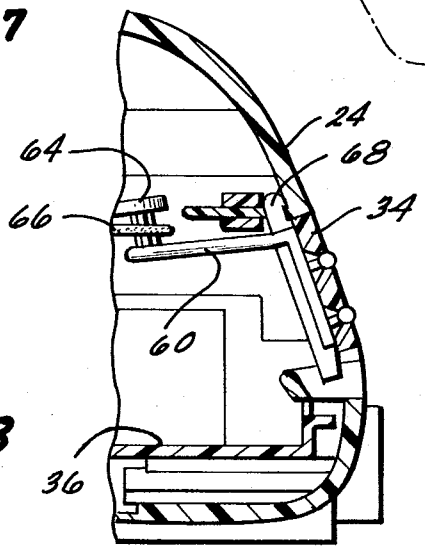
FIG. 8
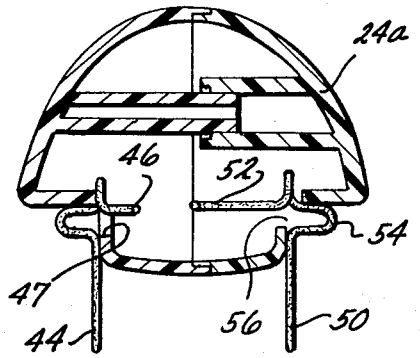
FIG. 7

TOY CARGO PLANE

DESCRIPTION

1. Technical Field

This invention relates generally to toys and, more particularly, to scale model toy cargo jet planes.

2. Background Art

Many scale model airplanes are known, some of which contain motors or the like to propel them through the air. Others contain wheels and/or moving parts so that a child may drive or push the plane over a surface to simulate take offs, landings and other simulated play situations.

In addition, large cargo aircraft such as those disclosed in U.S. Pat. Nos. 3,741,508, 4,039,163 and 4,165,810 show cargo handling ramps suitable for loading and unloading various kinds of cargo between ground level, on which the cargo plane is parked, and the elevated cargo bay of the plane.

Finally, toy vehicles are known in which front doors open to enable other toys to be loaded or unloaded from the vehicle. One such vehicle is the space toy disclosed in U.S. Pat. No. 4,249,339, owned by Mattel, Inc., the assignee of the present invention.

However, none of the known art discloses, either in a real or toy cargo plane, front doors which may be opened by a mechanism mounted within the plane, together with a further mechanism for mechanically withdrawing into or pushing out of the plane a ramp, after or during opening of the front doors.

DISCLOSURE OF THE INVENTION

In accordance with the present invention, a toy having a main fuselage with a plurality of doors fixed to the fuselage is disclosed. The toy includes means for mechanically opening the doors, including a rod slideable within the fuselage and secured to the doors so that upon sliding of the rod along its axis, the doors will be moved between open and closed positions. At the same time, the toy is provided with means for mechanically moving a cargo loading and unloading ramp into and out of the fuselage.

The toy also includes a rear door for inserting cargo or toys in and out of the the plane onto the moveable cargo ramp, and means on the doors, the wings, and the elevator to allow the same to be released from the fuselage upon impact of the toy with a surface, to prevent breakage of the toy.

Further objects features and advantages of the invention will become apparent upon a reading of the specification when taken in conjunction with the drawings in which like reference numerals refer to like elements in the several views.

BRIEF DESCRIPTION OF THE DRAWINGS

FIG. 1 is a perspective view of the toy cargo plane in accordance with the present invention showing its front doors in the open position, with the sliding cargo ramp extended outwardly from the interior cargo area of the plane and having its front tongue contacting a surface;

FIG. 2 is a partial top plan view of the cargo plane of FIG. 1 showing the cargo doors in the open position with the ramp extended out, and showing the fuselage, tail and wings of the plane in outline;

FIG. 7 is a partial sectional view taken along line 7—7 of FIG. 2;

FIG. 8 is a partial sectional view taken along line 8—8 of FIG. 5;

FIG. 9 is a partial sectional view taken along line 9—9 of FIG. 1 showing the attachment of the wings to the main fuselage;

FIG. 10 is a partial sectional view taken along line 10—10 of FIG. 1 showing the elevator removeably attached to the rear tail section and;

FIG. 11 is a partial sectional view taken along line 11—11 of FIG. 1 showing a wheel and means for holding the wheel to the body.

BEST MODE FOR CARRYING OUT THE INVENTION

Figure 3:
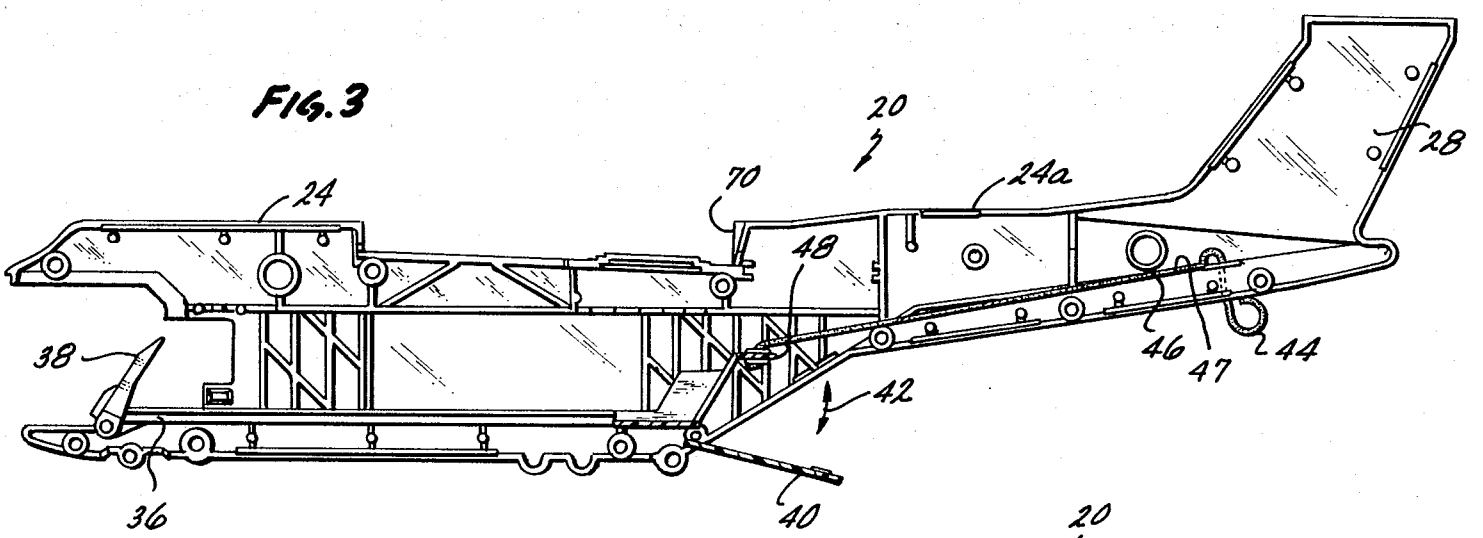
FIG. 3 is a partial sectional view taken along line 3—3 of FIG. 2.

Referring now to the drawings and particularly FIG. 1, there shown is a toy cargo plane 20 of the present invention, resting on a surface 22, which could be a simulated runway. The plane includes a fuselage or body 24, having removeably attached thereto wings 26. The fuselage includes a tail assembly 28 having an elevator 30. A plurality of engine pods 27 are fixed to and extend downwardly from the wings. The front of the fuselage is provided with a pair of pivoting front doors 32, 34, generally in the shape of a clamshell. A ramp 36, having a front tongue 38 pivotably mounted to the ramp, is slideably held within the interior of the plane, for extension into and out through the front doors 32, 34, when the doors are in the open position.

As shown more clearly in FIG. 3, a rear door 40 is pivotably mounted within the rearwardly extending portion of the fuselage for movement, as shown by arrow 42, between an open position, (as shown) and a closed position, locked to the fuselage. Cargo, such as toy cars may be inserted through the rear door opening, directly onto the ramp 36, through a further opening (see FIGS. 2 and 8) at the rear of the ramp.

Figure 4:
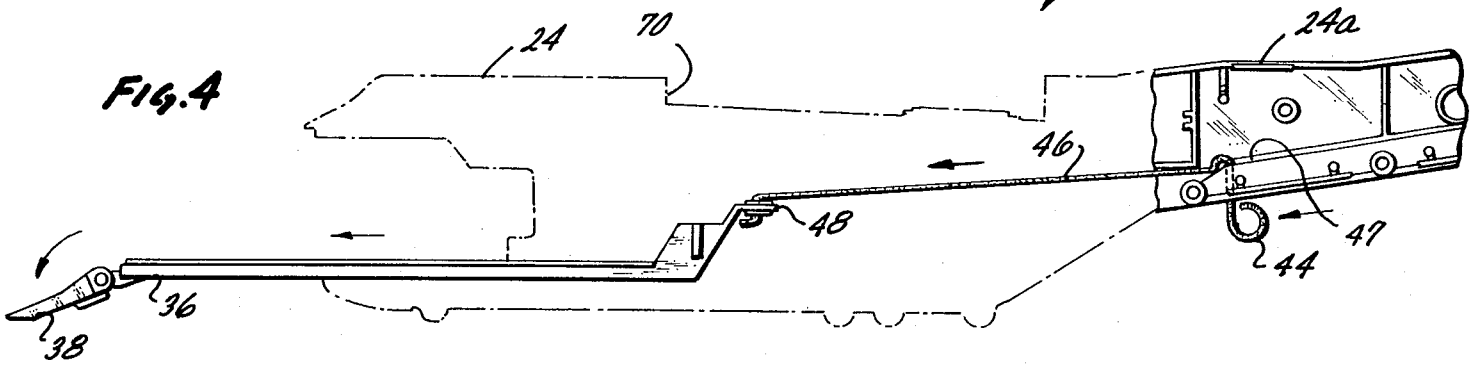
FIG. 4 is a partial sectional view similar to that shown in FIG. 3 with the ramp in the fully extended position.

FIGS. 2–8 show remote operating means for mechanically opening the doors and moving the ramp 36 into and out of the interior of the plane, through the open doors. The ramp operating means comprises a lever 44, preferably in the form of a ring, connected to a rod 46, coupled in any convenient manner, to an upwardly extending rear portion 48 of the ramp 36. Lever 44 is guided within a slot or other guide means 47 formed or held within the reduced area rear portion **24*a* of the fuselage 24. The lever 44 and ramp 36 are moved between an inner closed position (see FIG. 3) and a forward or outer, fully extended position, as shown in FIGS. 1, 2 and 4**.

Figure 5:
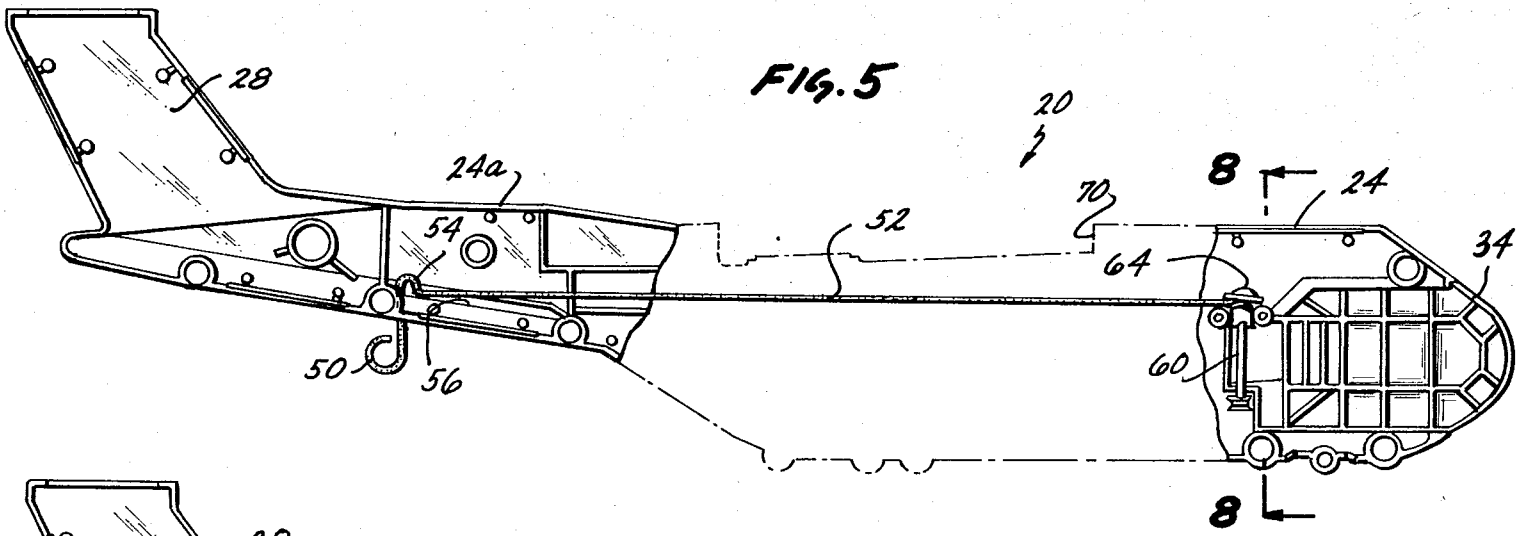
FIG. 5 is a partial sectional view taken along line 5—5 of FIG. 2.
Figure 6:
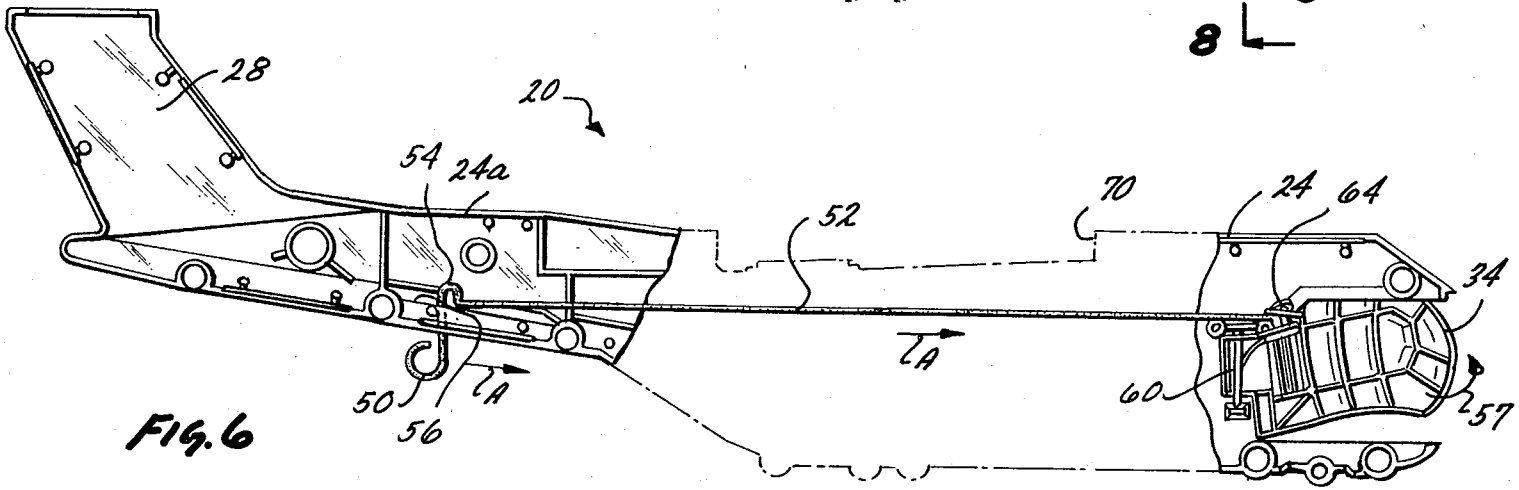
FIG. 6 is a partial sectional view similar to that shown in FIG. 5 with the door operating rod and doors moving to the open position.

Normally, before the ramp 36 is extended outwardly from the interior of the plane, the clamshell doors are moved from their closed position (FIGS. 5 and 8, with the front portions thereof contacting each other) to the open position, (as shown in FIGS. 1, 2, and 6). The doors are operated by a lever 50, generally in the shape of a ring, coupled to a rod 52, as by means 54. The doors are opened by moving the lever 50 and rod 52 in the direction of arrow A (FIGS. 2 and 6). The lever 50 moves within a slot or other guide means 56 formed or held in the reduced rear area 24*a*. This is more clearly shown in FIGS. 5 and 6, with FIG. 5 showing the lever 50 in the starting positon. That is, door 34 is in the closed position. FIG. 6, shows lever 50 moving in the direction of the arrow A, with the rod 52 moving in the same direction, to commence opening of the door, in the direction of arrow 57. When the lever 50 reaches the end of the slot 56, the doors 32, 34, will be in the fully opened position.

As shown in FIGS. 2 and 8, the doors 32, 34 are releasably mounted on hinge elements 58, 60, as by locking elements or the like, extending through the doors. Each of the hinges includes a button member 62, 64 over which a looped end 66 of rod 52 is held in position. Upon movement of the rod 52 by the lever 50, the hinges, and therefore the doors 32, 34 will be pivoted with respect to the fuselage 24. Each of the hinges is identical, and as shown in FIG. 8, hinge 60 is coupled to the fuselage 24 by means of a pin member 68 pivotably held to the fuselage in any convenient manner. Door 32 is coupled to the body 24 in an identical manner to enable each of the doors to pivot with respect to the fuselage about its respective pin member.

In addition to the unique operating features of the pivoting doors 32, 34 and the extensible ramp 36, the toy cargo plane of the present invention is provided with constructional features which allow a child to play with the plane without fear of breaking the same should the plane be accidentally dropped or over-zealously thrown or played with.

In particular, as described above, the doors 32 and 34 are releasably mounted on hinges 58 and 60, so that if the doors or the nose of the plane is struck, or the plane impacts against an object, the doors may break away from the hinges, without actually breaking any parts. The doors may be remounted to, or snapped back onto the hinges, without requiring special tools or fixing agents. In addition, the wings 26 are releaseably mounted within an opening 70 formed at the top of the fuselage 24, and the elevator 30 is releasably mounted at the end of the tail assembly 28. At the same time, the engine pods 27 are releasably mounted within openings 72 formed in the wings. As shown in FIG. 9, the wings 26 are provided with forwardly and rearedly extending lips 74, 76 which fit within grooves 78, 80 formed within the opening 70 whereby when sufficient force is applied to the wings 26, instead of breaking, the wings will be forced or released from the opening 70. The wings may be easily reinserted or snapped back into the opening, without requiring glue or other fixing agents.

The elevator 30 is releasably held to the tail assembly 28 by extending or rounded abutements 82 formed on the tail assembly, coacting with a groove and lip 84 formed internally of the elevator on either side thereof (see FIG. 10). In addition, the engine pods 27 are provided with extending tips or rounded ends (not shown), which are forceably fitted into the openings 72 in wings 26. Therefore, upon impact of the engine pods with a surface, the engine pods are released from the wings, without damaging either the wings or the engine pods. The elevator and engine pods may be easily reinserted or snapped back into place on the cargo plane.

It therefore can be seen that a novel and unique toy cargo plane has been disclosed. The plane includes operating front and rear doors, as well as ramp means for loading and unloading toy vehicles or other cargo into the plane for enjoyment by a child. The plane is constructed so that if accidently dropped or vigorously played with by a child, any impact forces against the front doors, main wings, elevator and engine pods act to break away or release the same by means of flexible component design and locking elements and/or slots and grooves for positioning.

While there has been shown and described a preferred embodiment of the invention, it is to be understood that other adaptations or modifications may be made within the spirit and scope of the invention, as set forth in the attached claims.

We claim:

1. A toy cargo plane having a fuselage; a pair of front doors moveably affixed to said fuselage; means for manually opening and closing said front doors including a rod slideably carried in said fuselage, said rod having a lever fixed thereto and being formed so as to be capable of being grasped by the hand of a user for moving said rod along its axis; means attached to said rod cooperating with said front doors for moving said front doors; and further manually operated means slideably carried in said fuselage for moving a ramp in and out of said front doors, when said front doors are opened.

2. A toy cargo plane as claimed in claim 1 in which the means for moving said front doors comprises a ring fixed to said rod, and loop means pivotable coupling said rod to hinge means on said front doors in a position to rotate said front doors, and said further manually operated means includes a further rod coupled to said ramp slideably carried in said fuselage and moveable along its axis by the hand of a user.

3. A toy cargo plane as claimed in claim 2 in which said ramp has an inner and an outer end with said further rod coupled to said inner end, and said outer end includes a tongue rotatably mounted thereon; said tongue being moveable from a closed position, above said ramp, to an opened position adapted to touch a surface on which said toy cargo plane rests, to allow further toys to be moved on and off said ramp.

4. A toy cargo plane as claimed in claim 3 wherein said fuselage has a front end and a tail end, said front end containing said front doors, said front doors being opposed to each other and opening away from each other, along an axis substantially parallel to a surface on which said toy cargo plane rests, upon manual actuation of said rod along its axis by the hand of a user.

5. A toy cargo plane as claimed in claim 1 wherein said fuselage includes a top, with an opening formed therein, and a set of wings removeably fixed within said opening.

6. A toy cargo plane as claimed in claim 1 wherein said front doors are removeably carried by hinges rotatably mounted at the front of said fuselage.

7. A toy cargo plane as claimed in claim 1 wheren said fuselage includes wings removeably mounted to said fuselage with engine pods removeably mounted to said wings, and a tail assembly fixed to the tail end of said fuselage with a removeable elevator section coupled to said tail assembly.

8. A toy cargo plane having a main body with a front section and a tail section;

two front doors removeably coupled to a pair of hinges pivotably held to said front section of said main body;

a lever formed in a ring slideably held within a slot formed in the tail section of said main body and coupled to one end of a rod for mechanically opening said front doors upon sliding movement of said rod along its axis, said rod including a loop at the other end thereof spanning and mechanically coupled to said hinges for movement of said doors upon movement of said rod along its axis to rotate said doors between open and closed positions;

a further lever slideably mounted within a slot adjacent to said first slot formed within said tail assembly of said main body and coupled to a ramp slideably mounted within said body for moving said ramp out of said body through said front doors; and a rear door rotatably mounted within said main body adjacent said tail section, said rear door moveable between open and closed positions, whereby cargo may be inserted into said front section of said main body onto said ramp, when said rear door is in said open position.

* * * * *